US006620343B1

(12) United States Patent
Blok et al.

(10) Patent No.: US 6,620,343 B1
(45) Date of Patent: Sep. 16, 2003

(54) PTC CONDUCTIVE COMPOSITION CONTAINING A LOW MOLECULAR WEIGHT POLYETHYLENE PROCESSING AID

(75) Inventors: Edward J. Blok, Wadsworth, OH (US); Jeffrey A. West, Bellville, OH (US)

(73) Assignee: Therm-O-Disc Incorporated, Mansfield, OH (US)

( * ) Notice: Subject to any disclaimer, the term of this patent is extended or adjusted under 35 U.S.C. 154(b) by 0 days.

(21) Appl. No.: 10/102,435

(22) Filed: Mar. 19, 2002

(51) Int. Cl.[7] ..... H01B 1/24; H01C 7/02; H01C 8/00

(52) U.S. Cl. ..... 252/511; 338/22 R; 338/225 D

(58) Field of Search ..... 252/511, 512; 524/495, 496; 338/22 R, 225 D

(56) References Cited

U.S. PATENT DOCUMENTS

| | | | | |
|---|---|---|---|---|
| 4,237,441 A | | 12/1980 | van Konynenburg et al. | |
| 4,388,607 A | | 6/1983 | Toy et al. | |
| 4,534,889 A | | 8/1985 | van Konynenburg et al. | |
| 4,818,439 A | * | 4/1989 | Blackledge et al. | 252/511 |
| 5,174,924 A | | 12/1992 | Yamada et al. | |
| 5,580,493 A | | 12/1996 | Chu et al. | |
| 5,582,770 A | | 12/1996 | Chu et al. | |
| 5,837,164 A | | 11/1998 | Zhao | |
| 5,985,182 A | | 11/1999 | Zhao | |
| 6,452,476 B1 | * | 9/2002 | Handa | 338/22 R |

FOREIGN PATENT DOCUMENTS

| | | | |
|---|---|---|---|
| CN | 1197088 A | * | 10/1998 |
| CN | 1222743 A | * | 7/1999 |
| JP | 62-156159 A | * | 7/1987 |

OTHER PUBLICATIONS

EPOLENE Waxes, Eastman Chemical Products, Kingsport Tennessee Publication No. F–165L (no date available).*

* cited by examiner

*Primary Examiner*—Mark Kopec
(74) *Attorney, Agent, or Firm*—Harness, Dickey & Pierce, P.L.C.

(57) ABSTRACT

The invention provides polymeric PTC compositions and electrical PTC devices with higher voltage capability and improved electrical stability. The PTC compositions of the present invention exhibit improved processability and include at a minimum an organic polymner, a conductive filler and a low molecular weight polyethylene processing aid. Depending on device design, the composition can be used in low to high voltage applications.

46 Claims, 1 Drawing Sheet

PTC CONDUCTIVE COMPOSITION CONTAINING A LOW MOLECULAR WEIGHT POLYETHYLENE PROCESSING AID

BACKGROUND OF THE INVENTION

The invention relates generally to polymeric positive temperature coefficient (PTC) compositions and electrical PTC devices. In particular, the invention relates to polymeric PTC compositions containing low molecular weight polyethylene processing aids which are suitable for high temperature applications.

Electrical devices comprising conductive polymeric compositions that exhibit a PTC effect are well known in electronic industries and have many applications, including their use as constant temperature heaters, thermal sensors, low power circuit protectors and over current regulators for appliances and live voltage applications, by way of non-limiting example. A typical conductive polymeric PTC composition comprises a matrix of a crystalline or semi-crystalline thermoplastic resin (e.g., polyethylene) or an amorphous thermoset resin (e.g., epoxy resin) containing a dispersion of a conductive filler, such as carbon black, graphite chopped fibers, nickel particles or silver flakes. Some compositions additionally contain flame retardants, stabilizers, antioxidants, anti-ozonants, accelerators, pigments, foaming agents, crosslinking agents, dispersing agents and inert fillers.

At a low temperature (e.g. room temperature), the polymeric PTC composition has an ordered structure that provides a conducting path for an electrical current, presenting low resistivity. However, when a PTC device comprising the composition is heated or an over current causes the device to self heat to a melting temperature, a transition from a crystalline phase to an amorphous phase, resulting in a large thermal expansion, presents a high resistivity. In electrical PTC devices, for example, this resistivity limits the load current, leading to circuit shut off. In the context of this invention $T_s$ is used to denote the "switching" temperature at which the "PTC effect" (a rapid increase in resistivity) takes place. The sharpness of the resistivity change as plotted on a resistance versus temperature curve is denoted as "squareness", i.e., the more vertical the curve at the $T_s$, the smaller is the temperature range over which the resistivity changes from the low to the maximum values. When the device is cooled to the low temperature value, the resistivity will theoretically return to its previous value. However, in practice, the low temperature resistivity of the polymeric PTC composition may progressively increase as the number of low-high-low temperature cycles increases, an instability effect. Crosslinking of a conductive polymer by chemicals or irradiation, or the addition of inert fillers or organic additives may be employed to improve electrical stability.

Attempts to improve the electrical stability have involved the use of high cure states, high molecular weight polymers and high levels of inert fillers. While these can significantly improve the resistance stability, the last two options adversely affect the processability of the material. Using higher states of cure adersely affects costs and voltage capability of the device.

In view of the foregoing, there is still a need for the development of polymeric PTC compositions and devices comprising them that exhibit a high PTC effect, have a low initial resistivity, that exhibit substantial electrical and thermal stability, and that are readily processable.

SUMMARY OF THE INVENTION

The invention provides polymeric PTC compositions and electrical PTC devices having increased voltage capabilities while maintaining a low RT resistance. In particular, the polymeric compositions also demonstrate a high PTC effect (the resistivity at the $T_s$ is at least $10^3$ times the resistivity at 25° C.) and a low initial resistivity at 25° C. (preferably 10 Ωcm or less, more preferably 5 mΩ or less). The electrical PTC devices comprising these polymeric PTC compositions preferably have a resistance at 25° C. of 500 mΩ or less (preferably about 5 mΩ to about 500 mΩ, more preferably about 7.5 mΩ to about 200 mΩ, typically about 10 mΩ to about 100 mΩ) with a desirable design geometry.

The polymeric PTC compositions of the invention, demonstrating the above characteristics, comprise an organic polymer, a conductive filler and a low molecular weight polyethylene processing aid. Optionally, but preferably, one or more additives selected from the group consisting of inert fillers, flame retardants, stabilizers, antioxidants, anti-ozonants, accelerators, pigments, foaming agents, crosslinking agents, coupling agents, co-agents and dispersing agents, by way of non-limiting example, may be employed. The compositions may or may not be crosslinked to improve electrical stability before or after their use in the electrical PTC devices of the invention. Preferably, the polymer component of the composition has a melting point ($T_m$) of 100° C. to 250° C.

The electrical PTC devices of the invention have, for example, the high voltage capability to protect equipment operating on line current voltages from overheating and/or overcurrent surges. The devices are particularly useful as self-resetting sensors for AC motors, such as those of household appliances, such as dishwashers, washers, refrigerators and the like. Additionally, PTC compositions for use in low voltage devices such as batteries, actuators, disk drives, test equipment and automotive applications are also described below.

DETAILED DESCRIPTION OF THE INVENTION

Figure 1:
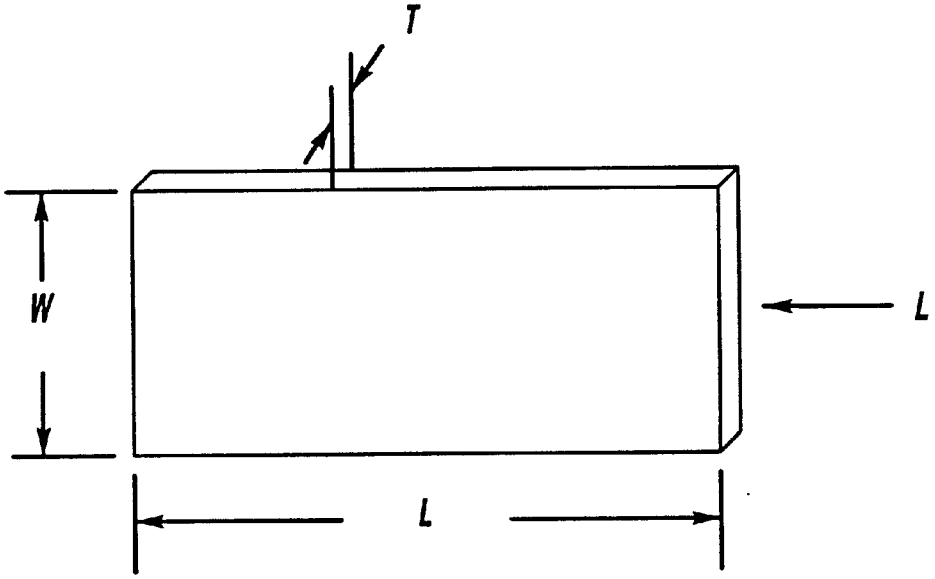
FIG. 1 is a schematic illustration of a PTC chip comprising the polymeric PTC composition of the invention sandwiched between two metal electrodes.

The polymeric PTC compositions of the invention comprise an organic polymer, a conductive filler and a low molecular weight polyethylene processing aid. Optionally, but preferably, one or more additives selected from the group consisting of inert fillers, flame retardants, stabilizers, antioxidants, anti-ozonants, accelerators, pigments, foaming agents, crosslinking agents, coupling agents, co-agents and dispersing agents, by way of non-limiting example, may be employed. While not specifically limited to high voltage applications, for purposes of conveying the concepts of the present invention, PTC devices employing the novel PTC polymeric compositions will generally be described with reference to high voltage embodiments. The criteria for a high voltage capacity polymeric composition generally are (i) a high PTC effect, (ii) a low initial resistivity at 25° C., and (iii) the capability of withstanding a voltage of 110 to 240 VAC or greater while maintaining electrical and thermal stability. As used herein, the term "high PTC effect" refers to a composition resistivity at the $T_s$ that is at least $10^3$ times the composition resistivity at room temperature (for convenience, 25° C.). There is no particular requirement as to the temperature at which the composition switches to its higher resistivity state.

As used herein, the term "low initial resistivity" refers to an initial composition resistivity at 25° C. of 100 Ωcm or less, preferably 10 Ωcm or less, more preferably 5 Ωcm or less, especially 2 Ωcm or less, thus providing for a PTC device having a low resistance at 25° C. of about 500 mΩ or less, preferably about 5 mΩ to 500 mΩ, more preferably about 7.5 mΩ to about 10 mΩ to about 200 mΩ, typically about 10 Ωm to about 100 mΩ, with an appropriate geometric design and size, as discussed further below.

The organic polymer component of the composition of the present invention is generally selected from a crystalline organic polymer, an elastomer (such as polybutadiene or ethylene/propylene/diene (EPDM) polymer) or a blend comprising at least one of these. Suitable crystalline polymers include polymers of one or more olefins such as polyethylenes, and particularly high density polyethylenes; copolymers of at least one olefin and at least one monomer copolymerisable therewith such as ethylene acrylic acid, ethylene ethyl acrylate and ethylene vinyl acetate; melt shapeable fluoropolymers such as polyvinylidene fluoride and ethylene tetrafluoroethylene and blends of two or more such crystalline polymers.

It is known that the $T_s$ of a conductive polymeric composition is generally slightly below the melting point ($T_m$) of the polymeric matrix. If the thermal expansion coefficient of the polymer is sufficiently high near the $T_m$, a high PTC effect may occur.

The preferred semi-crystalline polymer component in the conductive polymeric composition of the present invention has a crystallinity of at least about 10% and preferably between about 40% to 98%. In order to achieve a composition with a high PTC effect, it is preferable that the polymer has a melting point ($T_m$) in the temperature range of 60° C. to 300° C. Preferably, the polymer substantially withstands decomposition at a processing temperature that is at least 20° C. and preferably less than 120° C. above the $T_m$.

The crystalline or semi-crystalline polymer component of the conductive polymeric composition may also comprise a polymer blend containing, in addition to the first polymer, between about 0.5 to 50.0% of a second crystalline or semi-crystalline polymer based on the total polymeric component. The second crystalline or semi-crystalline polymer is preferably a polyolefin-based or polyester-based thermoplastic elastomer. Preferably the second polymer has a melting point ($T_m$) in the temperature range of 100° C. to 200° C. and a high thermal expansion coefficient value.

The electrically conductive fillers to be employed may include carbon blacks, graphite and metal particles, or a combination of these, by way of non-limiting example. Preferred carbon blacks are those having an iodine adsorption of between about 10.0 to 80.0 mg/g and a dibutyl phthalate absorption of between about 40.0 to about 250.0 ml/100g. More preferably, the carbon black will have an iodine adsorption of between about 16.0 mg/g to about 50.0 mg/g. Preferably, the DBP absorption should range from between about 50.0 to about 120.0 ml/100g. As should be understood by those skilled in the art DBP absorption is measured in accordance with ASTM D-2414-79.

Other conductive fillers which are known in the art include metal particles, by way of non-limiting example. Among the useful metal particles are nickel particles, silver flakes, or particles of tungsten, molybdenum, gold platinum, iron, aluminum, copper, tantalum, zinc, cobalt, chromium, lead, titanium, tin alloys or mixtures of the foregoing. Still other conventional conductive fillers may be used provided they do not limit processability or deice resistance. The total conductive filler employed will generally range from 40.0 phr to 350.0 phr and, preferably, from 60.0 phr to 250.0 phr. It should be understood that "phr" means parts per 100.0 parts of the organic polymer component.

In addition to the polymeric component and conductive filler, the PTC composition will generally include a low molecular weight polyethylene processing aid. By low molecular weight polyethylenes, it is meant that the Mn should be up to about 50,000 and the Mw should be up to about 50,000. Preferred low molecular weight polyethylenes will have an Mn of between about 1,000 to about 50,000 and an Mw of between about 1,000 to about 50,000. Further, the low molecular weight polyethylenes will be in the form of substantially linear molecules, i.e., will include a minimal amount of branched chains, if any. Useful commercially available low molecular weight polyethylene compounds are available from the Eastman Chemical Company under the trade designations EPOLENE N-10 and EPOLENE N-20. The total amount of low molecular weight polyethylene processing aid employed will be up to about 40.0 phr and preferably will be present in a range of from about 0.25 phr to about 15 phr.

In addition to the organic polymer, conductive filler and low molecular weight polyethylene, the polymeric PTC compositions of the present invention may include one or more additives selected from the group consisting of inert fillers, flame retardants, stabilizers, antioxidants, antiozonants, accelerators, pigments, foaming agents, crosslinking agents, coupling agents, co-agents and dispersing agents, by way of non-limiting example. The inert filler component, if any, comprises fibers formed from a variety of materials including, but not limited to, carbon, polypropylene, polyether ketone, acryl synthetic resins, polyethylene terephthalate, polybutylene terephthalate, cotton and cellulose. The total amount of fibers employed, generally range from between about 0.25 phr to about 50.0 phr and, preferably, from about 0.5 phr to about 10.0 phr.

Additional inert fillers may also be employed including, for example, silicon, nylons, fumed silica, calcium carbonate, magnesium carbonate, aluminum hydroxide, titanium oxide, kaolin clay, barium sulphate, talc, chopped glass or continuous glass, among others. The total inert filler component ranges from 2.0 phr to about 100.0 phr and, preferably, from 4.0 phr to about 12.0 phr.

Examples of suitable stabilizers particularly for electrical and mechanical stability, include metal oxides, such as magnesium oxide, zinc oxide, aluminum oxide, titanium oxide, or other materials, such as calcium carbonate, magnesium carbonate, alumina trihydrate, and magnesium hydroxide, or mixtures of any of the foregoing. The proportion of stabilizers selected from the above list, among others is generally in the range of between about 0.1 phr and 30.0 phr and, preferably between about 0.5 phr to 15.0 phr.

Antioxidants may be optionally added to the composition and may have the added effect of increasing the thermal stability of the product. In most cases, the antioxidants are either phenol or aromatic amine type heat stabilizers, such as N,N'1,6-hexanediylbis (3,5bis (1,1-dimethylethyl)-4-hydroxybenzene) propanamide (Irganox 1098, available from Ciba Geigy Corp., Hawthorne, N.Y.), N-stearoyl-4-aminophenol, N-lauroyl-4-aminophenol, and polymerized 1,2-dihydro-2,2,4-trimethyl quinoline. The proportion by weight of the antioxidant agent in the composition may range from 0.1 phr to 15.0 phr and, preferably 0.25 phr to 5.0 phr.

To enhance electrical stability, the conductive polymer composition may be crosslinked by chemicals, such as organic peroxide compounds, or by irradiation, such as by a high energy electron beam, ultraviolet radiation or by gamma radiation, as known in the art. Although crosslinking is dependent on the polymeric components and the application, normal crosslinking levels are equivalent to that achieved by an irradiation dose in the range of 1 to 150 Mrads, preferably 2.5 to 20 Mrads, e.g., 10.0 Mrads. If crosslinking is by irradiation, the composition may be crosslinked before or after attachment of the electrodes.

Figure 2:
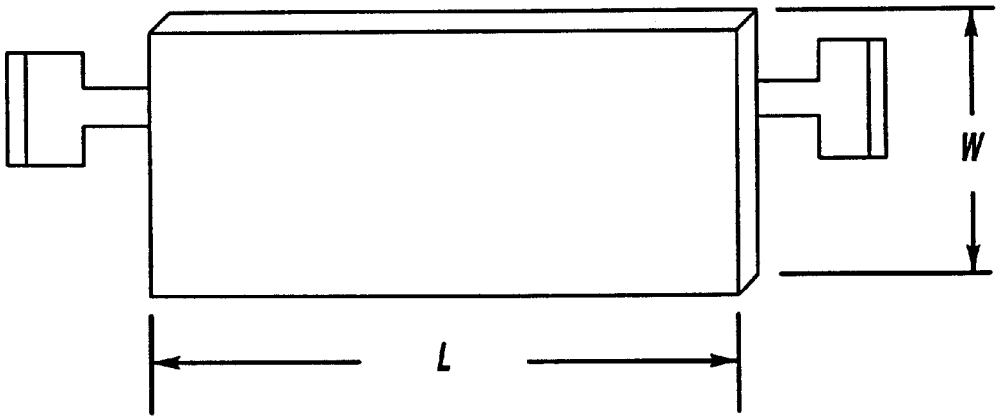
FIG. 2 is a schematic illustration of an embodiment of a PTC device according to the invention, comprising the PTC chip of FIG. 1 with two attached terminals.

In an embodiment of the invention, the high temperature PTC device of the invention comprises a PTC "chip" 1 illustrated in FIG. 1 and electrical terminals 12 and 14, as described below and schematically illustrated in FIG. 2. As shown in FIG. 1, the PTC chip 1 comprises the conductive polymeric composition 2 of the invention sandwiched between metal electrodes 3. The electrodes 3 and the PTC composition 2 are preferably arranged so that the current flows.through the PTC composition over an area L×W of the chip 1 that has a thickness, T, such that W/T is at least 2, preferably at least 5, especially at least 10. The electrical resistance of the chip or PTC device also depends on the thickness and the dimensions W and L, and T may be varied in order to achieve a preferable resistance, described below. For example, a typical PTC chip generally has a thickness of 0.05 to 5 millimeters (mm), preferably 0.1 to 2.0 mm, and more preferably, 0.2 to 1.0 mm. The general shape of the chip/device may be that of the illustrated embodiment or may be of any shape with dimensions that achieve the preferred resistance.

It is generally preferred to use two planar electrodes of the same area which are placed opposite to each other on either side of a flat PTC polymeric composition of constant thickness. The material for the electrodes is not specially limited, and can be selected from silver, copper, nickel, aluminum, gold and the like. The material can also be selected from combinations of these metals, nickel plated copper, tinplated copper, and the like. The electrodes are preferably used in a sheet form. The thickness of the sheet is generally less than 1 mm, preferably less than 0.5 mm, and more preferably less than 0.1 mm.

The conductive polymeric compositions of the invention are prepared by methods known in the art. In general, the polymer or polymer blend, the conductive filler and additives (if appropriate) are compounded at a temperature that is at least 20° C. higher, but generally no more than 120° C. higher, than the melting temperature of the polymer or polymer blend. Rather than compounding the additives at the same time as the polymer or polymer blend, it may be desirable to first form a dispersion of the polymer and conductive filler, i.e. carbon black and thereafter blend in the additives. After compounding, the homogeneous composition may be obtained in any form, such as pellets. The composition is then r subjected to a hotpress compression or extrusion/lamination process and transformed into a thin PTC sheet.

PTC sheets obtained, e.g., by compression molding or extrusion, are then cut to obtain PTC chips having predetermined dimensions and comprising the conductive polymeric composition sandwiched between the metal electrodes. The composition may be crosslinked, such as by irradiation, if desired, prior to cutting of the sheets into PTC chips. Electrical terminals are then soldered to each individual chip to form PTC electrical devices.

A suitable solder provides good bonding between the terminal and the chip at 25° C. and maintains a good bonding at the switching temperature of the device. The bonding is characterized by the shear strength. A shear strength of 250 Kg or more at 25° C. for a 2×1 cm2 PTC device is generally acceptable. The solder is also required to show a good flow property at its melting temperature to homogeneously cover the area of the device dimension. The solder used generally has a melting temperature of 20° C., preferably 40° C. above the switching temperature of the device.

The following examples illustrate embodiments of the conductive polymeric PTC compositions and electrical PTC devices of the present invention particularly demonstrating a significant improvement over compositions employing oils such as Sunpar 2280 available from Sun Chemical to improve processability. However, these embodiments are not intended to be limiting, as other methods of preparing the compositions and devices e.g., injection molding, to achieve desired electrical and thermal properties may be utilized by those skilled in the art. The compositions which are used in the production of PTC devices were tested for various PTC properties and particularly the trade off between resistance and voltage capability. The resistance of the PTC chips and devices is measured, using a four wire standard method, with a micro-ohmmeter (e.g., Keithley 580, Keithley Instruments, Cleveland, Ohio) having an accuracy of ±0.01Ω).

As reflected below, the overvoltage testing is conducted by a stepwise increase in the voltage starting at 5 volts. The voltage capability of the material is determined via dielectric failure.

EXAMPLES

Using the formulas shown in Table 1, the compounds were mixed for 30 minutes at 180° C. on a two roll mill. The compounds were then laminated between nickel coated copper foil using a Killian extruder. The sheet of PTC material was then cut into 11.1 by 20.0 mm chips and solder reflow was used to attach leads. The chips were then tested for resistance and voltage capabilities, with the following results being noted.

TABLE I

| | Formulations (based on phr) | | | |
|---|---|---|---|---|
| | Control A | Control B | Example 1 | Example 2 |
| HDPE | 100 | 93 | 93 | 93 |
| Carbon Black N762 | 175 | 175 | 175 | 175 |
| MgO | 6 | 6 | 6 | 6 |
| Agerite MA | 3.3 | 3.3 | 3.3 | 3.3 |
| Epolene C-14[1] | 0 | 7 | 0 | 0 |
| Epolene N-10[2] | 0 | 0 | 7 | 0 |
| Epolnene N-20[3] | 0 | 0 | 0 | 7 |

[1]Mn is 18,000; Mw is 143,000; MWD is 7.94; MP is 106
[2]Mn is 3,000; Mw is 10,000; MWD is 3.13; MP is 107.
[3]Mn is 5,500; Mw is 15,000; MWD is 2.73; MP is 115.
MP is the peak melting temperature determined by DSC.

TABLE II

| Properties of PPTC Compounds (110 kGrays)* | | | | |
|---|---|---|---|---|
| | Control A | Control B | Example 1 | Example 2 |
| Voltage Capability | | | | |
| Chip thickness (inches) | 0.0100 | 0.0103 | 0.0103 | 0.0104 |
| Device resistance mOhms (RT) | 7.27 | 7.02 | 7.66 | 7.39 |
| Voltage capability (DC) | 38 | 40 | 40 | 38 |
| Resistance stability (3,000 cycles; 10.5 volts; 20 amps; 40 sec. on; 70 sec. off) | | | | |
| % change in resistance | 51.7 | 61.9 | 48.0 | 55.5 |
| Processing (RPMs from extruder; same pressure and die gap) | | | | |
| RPMs | 1.9 | 2.1 | 2.6 | 2.6 |

*Average of six samples

Compounds in (phr) parts per 100.0 parts of the polymeric component unless otherwise indicated.

As should be understood from a review of the foregoing, the compositions set forth in Examples I and II exhibited a 26% improvement in extruder output with equal resistance stability and a slight increase in initial device resistance. The data indicates that further optimization in processing and performance is still possible by modifying Mn and Mw of the low molecular weight processing aid.

While the invention has been described herein with reference to the preferred embodiments, it is to be understood that it is not intended to limit the invention to the specific forms disclosed. On the contrary, it is intended to cover all modifications and alternative forms falling within the spirit and scope of the invention.

We claim:

1. A polymeric PTC composition comprising:

an organic polymer, a conductive filler and a substantially linear low molecular weight polyethylene processing aid.

2. The composition of claim 1, wherein said PTC composition further comprises one or more additives selected from the group consisting of inert fillers, flame retardants, stabilizers, antioxidants, anti-ozonants, accelerators, pigments, foaming agents, crosslinking agents, coupling agents, co-agents and dispersing agents.

3. The composition of claim 2, wherein said inert filler is present in an amount of between about 2.0 phr to 100.0 phr.

4. The composition of claim 2, wherein said stabilizers are present in an amount of between about0.1 phr and 15.0 phr.

5. The composition of claim 3, wherein said antioxidants are present in an amount 0.1 phr to about 15.0 phr.

6. The composition of claim 2, wherein the inorganic stabilizers are selected from the group consisting of magnesium oxide, zinc oxide, aluminum oxide, titanium oxide, calcium carbonate, magnesium carbonate, alumina trihydrate, magnesium hydroxide, and mixtures thereof.

7. The composition of claim 1, wherein said low molecular weight polyethylene processing aid has an $M_n$ of up to about 50,000 and an $M_w$ of up to about 50,000.

8. The composition of claim 1, wherein said low molecular weight polyethylene processing aid has an $M_n$ of between about 1,000 to about 50,000 and an $M_w$ of between about 1,000 to about 50,000.

9. The composition of claim 1, wherein said low molecular weight polyethylene processing aid is present in a positive amount up to about 40.0 phr.

10. The composition of claim 1, wherein the organic polymer includes a crystalline or semi-crystalline polymer.

11. The composition of claim 1, wherein the organic polymer includes at least one polymer selected from the group consisting of high density polyethylene, nylon-11, nylon-12, polyvinylidene fluoride and mixtures or copolymers thereof.

12. The composition of claim 1, wherein the polymer has a melting point, $T_m$ of 60° C. to 300° C.

13. The composition of claim 1, having a resistivity at 25° C. of 100 or less.

14. The composition of claim 1, wherein the conductive filler is present in an amount of between about 40.0 phr to about 350.0 phr.

15. The composition of claim 1, wherein the conductive filler is selected from the group consisting of carbon blacks, graphite, metal particles, and mixtures thereof.

16. The composition of claim 15, wherein the metal particles are selected from the group consisting of nickel particles, silver flakes, or particles of tungsten, molybdenum, gold, platinum, iron, aluminum, copper, tantalum, zinc, cobalt, chromium, lead, titanium, tin alloys, and mixtures thereof.

17. The composition of claim 1, wherein the antioxidant comprises a phenol or an aromatic amine.

18. The composition of claim 17, wherein the antioxidant is selected from the group consisting of N,N'1,6-hexanediylbis (3,5-bis-(1,1-dimethylethyl)-4-hydroxybenzene) propanamide, (N-stearoyl-4-aminophenol, N-lauroyl-4-aminophenol, polymerized 1,2-dihydro-2,2,4-trimethyl quinoline, and mixtures thereof.

19. The composition of claim 1, wherein the polymeric composition is crosslinked with the aid of a chemical agent or by irradiation.

20. The composition of claim 1, further comprising between about 0.5% to 50.0% of a second crystalline or semi-crystalline polymer based on the total polymeric component.

21. The composition of claim 1 wherein the organic polymer has a melting temperature $T_m$ of about 60° C. to about 300° C.

22. The composition of claim 1, wherein said processing aid has MWD of less than about 5.0.

23. The composition of claim 1, wherein said processing aid has MWD of less than about 3.2.

24. An electrical device which exhibits PTC behavior, comprising:

(a) a PTC composition comprising an organic polymer, a conductive filler and a substantially linear low molecular weight polyethylene processing aid; and (b) at least two electrodes which are in electrical contact with the conductive polymeric composition to allow a DC or an AC current to pass through the composition under an applied voltage, wherein the device has a resistance at 25° C. of 500 mΩ or less with a desirable design geometry.

25. The electrical device of claim 24, wherein said PTC composition further comprises, one or more additives selected from the group consisting of inert fillers, flame retardants, stabilizers, antioxidants, anti-ozonants, accelerators, pigments, foaming agents, crosslinking agents, coupling agents, co-agents and dispersing agents.

26. The electrical device of claim 25, wherein said low molecular weight polyethylene processing aid has an $M_n$ of up to about 50,000 and an $M_w$ of up to about 50,000.

27. The electrical device of claim 25, wherein said inert filler is present in an amount of between about 2.0 phr to 100.0 phr.

28. The electrical device of claim 25, wherein said stabilizers are present in an amount of between about 0.1 phr and 15.0 phr.

29. The device of claim 25, wherein said antioxidants are present in an amount 0.1 phr to about 15.0 phr.

30. The electrical device of claim 25, wherein the inorganic stabilizers are selected from the group consisting of magnesium oxide, zinc oxide, aluminum oxide, titanium oxide, calcium carbonate, magnesium carbonate, alumina trihydrate, magnesium hydroxide, and mixtures thereof.

31. The electrical device of claim 25, wherein the antioxidant comprises a phenol or an aromatic amine.

32. The electrical device of claim 31, wherein the antioxidant is selected from the group consisting of N,N'1,6-hexanediylbis (3,5-bis(1,1dimethylethyl)4-hydroxybenzene) propanamide, (N-stearoyl-4-aminophenol, N-lauroyl4-aminophenol, polymerized 1,2-dihydro-2,2,4-trimethyl quinoline, and mixtures thereof.

33. The electrical device of claim 24, wherein said low molecular weight polyethylene processing aid has an $M_n$ of between about 1,000 to about 50,000 and an $M_w$ of about 1,000 to about 50,000.

34. The electrical device of claim 24, wherein said low molecular weight polyethylene processing aid is present in a positive amount up to about 40.0 phr.

35. The electrical device of claim 24, wherein the organic polymer includes a crystalline or semi-crystalline polymer.

36. The electrical device of claim 24 wherein the organic polymer includes at least one polymer selected from the group consisting of high density polyethylene, nylon-11, nylon-12, polyvinylidene fluoride and mixtures or copolymers thereof.

37. The electrical device of claim 24, wherein the polymer has a melting point, $T_m$ of 60° C. to 300° C.

38. The electrical device of claim 24, having a resistivity at 25° C. of 100 or less.

39. The electrical device of claim 24, wherein the conductive filler is present in an amount of between about 40.0 phr to about 350.0 phr.

40. The electrical device of claim 24, wherein the conductive filler is selected from the group consisting of carbon blacks, graphite, metal particles, and mixtures thereof.

41. The electrical device of claim 40, wherein the metal particles are selected from the group consisting of nickel particles, silver flakes, or particles of tungsten, molybdenum, gold, platinum, iron, aluminum, copper, tantalum, zinc, cobalt, chromium, lead, titanium, tin alloys, and mixtures thereof.

42. The electrical device of claim 24, wherein the polymeric composition is crosslinked with the aid of a chemical agent or by irradiation.

43. The electrical device of claim 24, further comprising between about 0.5% to 50.0% of a second crystalline or semi-crystalline polymer based on the total polymeric component.

44. The electrical device of claim 24 wherein the organic polymer has a melting temperature $T_m$ of about 60° C. to about 300° C.

45. The electrical device of claim 24, wherein said processing aid has an MWD of less than about 5.0.

46. The electrical device of claim 24, wherein said processing aid has an MWD of less than about 3.2.

* * * * *

UNITED STATES PATENT AND TRADEMARK OFFICE

CERTIFICATE OF CORRECTION

PATENT NO. : 6,620,343 B1
DATED : September 16, 2003
INVENTOR(S) : Edward J. Blok et al.

It is certified that error appears in the above-identified patent and that said Letters Patent is hereby corrected as shown below:

Title page,
Item [57], ABSTRACT,
Line 6, “polymner” should be -- polymer --.

Column 5,
Line 25, “flows.through” should be -- flows through --.
Line 61, after “then” delete “r”.

Column 7,
Line 48, “about0.1” should be -- about 0.1 --.
Line 49, “3” should be -- 2 --.

Column 9,
Line 14, “lauroyl4” should be -- lauroyl-4 --.

Signed and Sealed this

Twenty-third Day of March, 2004

JON W. DUDAS
*Acting Director of the United States Patent and Trademark Office*